US006257923B1

(12) United States Patent
Stone et al.

(10) Patent No.: US 6,257,923 B1
(45) Date of Patent: Jul. 10, 2001

(54) DUAL MEDIA CONNECTOR FOR A VEHICLE

(75) Inventors: Timothy J. Stone, Minneapolis; Andrew J. Prust, Coon Rapids, both of MN (US)

(73) Assignee: Phillips & Temro Industries Inc., Eden Prairie, MN (US)

( * ) Notice: Subject to any disclaimer, the term of this patent is extended or adjusted under 35 U.S.C. 154(b) by 0 days.

(21) Appl. No.: 09/497,605

(22) Filed: Feb. 3, 2000

(51) Int. Cl.[7] ..... H01R 11/00
(52) U.S. Cl. ..... 439/502; 439/34; 280/422
(58) Field of Search ..... 439/502, 34, 535, 439/536; 280/422; 174/48, 153 G

(56) References Cited

U.S. PATENT DOCUMENTS 4,043,629 * 8/1977 Brannen ..... 439/536
5,002,502 * 3/1991 Hill ..... 439/536
5,542,859 * 8/1996 Ison et al. ..... 439/536
5,856,635 * 1/1999 Fujisawa et al. ..... 174/153 G
5,984,719 * 11/1999 Flegel ..... 439/535
6,024,599 * 2/2000 Stathis et al. ..... 439/535
6,081,964 * 7/2000 Mori ..... 174/153 G

OTHER PUBLICATIONS

Photograph of KIM Hotstart TV Connector, Part Number 80505–3407.
Photograph of KIM Hotstart Phone Connector (View A).
Photograph of KIM Hotstart Phone Connector (View B).

* cited by examiner

*Primary Examiner*—Tulsidas Patel
*Assistant Examiner*—Hae Moon Hyeon
(74) *Attorney, Agent, or Firm*—Harness, Dickey & Pierce, P.L.C.

(57) ABSTRACT

A dual media connector having a first media wire and a second media wire disposed within each of a housing insert, a rear seal, a conduit and a grommet, the first and second media wires adapted to electrically interconnect first and second communications devices with external communication signals.

20 Claims, 5 Drawing Sheets

DUAL MEDIA CONNECTOR FOR A VEHICLE

BACKGROUND OF THE INVENTION

1. Technical Field

The present invention relates generally to communication devices and, more particularly, to a dual media connector for a motor vehicle.

2. Discussion

With the advent of the information age, access to multiple media communication systems has become desirable from locations other than the home. Specifically, operators of cargo carrying vehicles such as class 7 and 8 tractors find themselves away from home a large portion of the time. In addition, many of these vehicles are equipped with sleeper cabs to allow the operator to rest within the vehicle while it is stationary. Accordingly, it is advantageous to equip such a vehicle with a media connector for coupling electronic devices such as telephones and computers to telephone lines or televisions to cable connections located at rest stops throughout North America.

Some manufactures have attempted to fulfill the need for on board communications devices but these early designs may be improved upon. For example, one existing media connector provides only a single media communication path per housing. If an operator wishes the option of connecting to both a telephone and a television media wire, multiple exterior body mounts, housings, conduits and cab apertures are required.

Additionally, serviceability is a concern due to the frequent connection and disconnection of external cables to the media wire mounted on the vehicle. Accordingly, a replaceable connection is important to long-term customer satisfaction. Counter to this theory, one manufacturer supplies a television media wire including a coaxial cable having a vinyl over-molded plug. While the over-molded plug serves to protect a portion of the wire from the weather, serviceability of the assembly is sacrificed. Specifically, replacement of the entire over-molded plug and media wire is required if any portion wears prematurely.

SUMMARY OF THE INVENTION

Accordingly, it is an object of the present invention to provide a dual media connector for a motor vehicle having a single mount and associated hardware.

It is another object of the present invention to provide media couplers which are easily serviceable.

The present invention relates to a dual media connector having a first media wire and a second media wire disposed within each of a housing insert, a rear seal, a conduit and a grommet. The first and second media wires are adapted to electrically interconnect first and second communications devices with external communication signals.

DETAILED DESCRIPTION OF THE PREFERRED EMBODIMENTS

Figure 1:
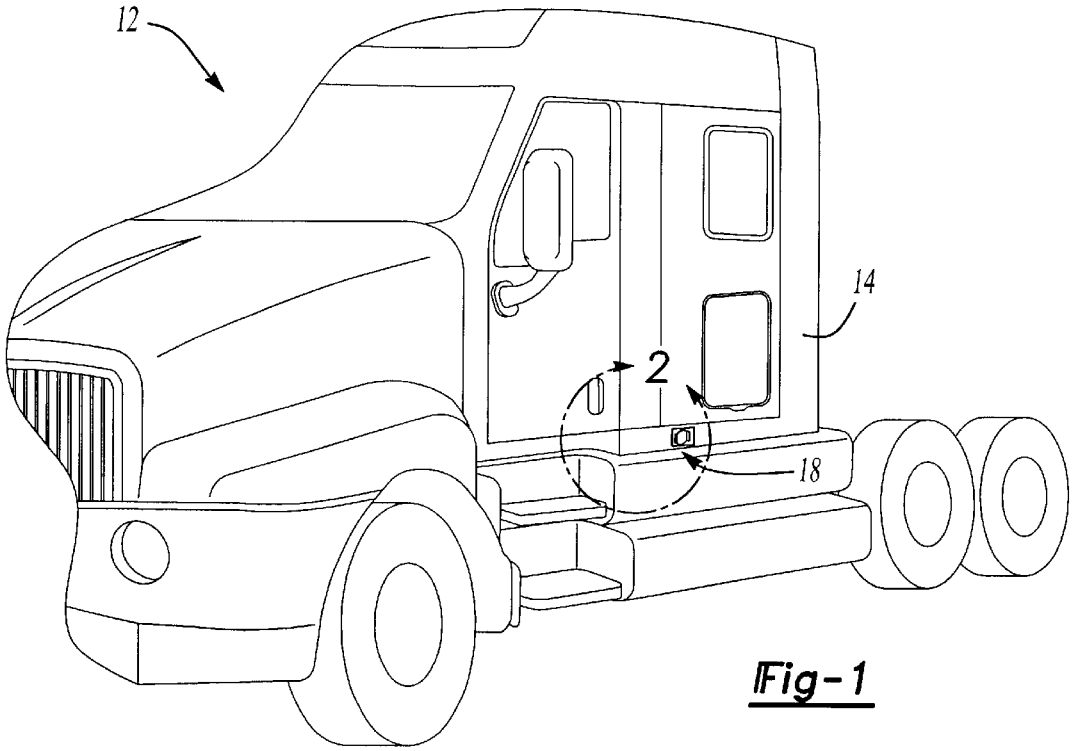
FIG. 1 is a partial perspective view of an exemplary vehicle equipped with an embodiment of the dual media connector constructed in accordance with the teachings of the present invention.
Figure 2:
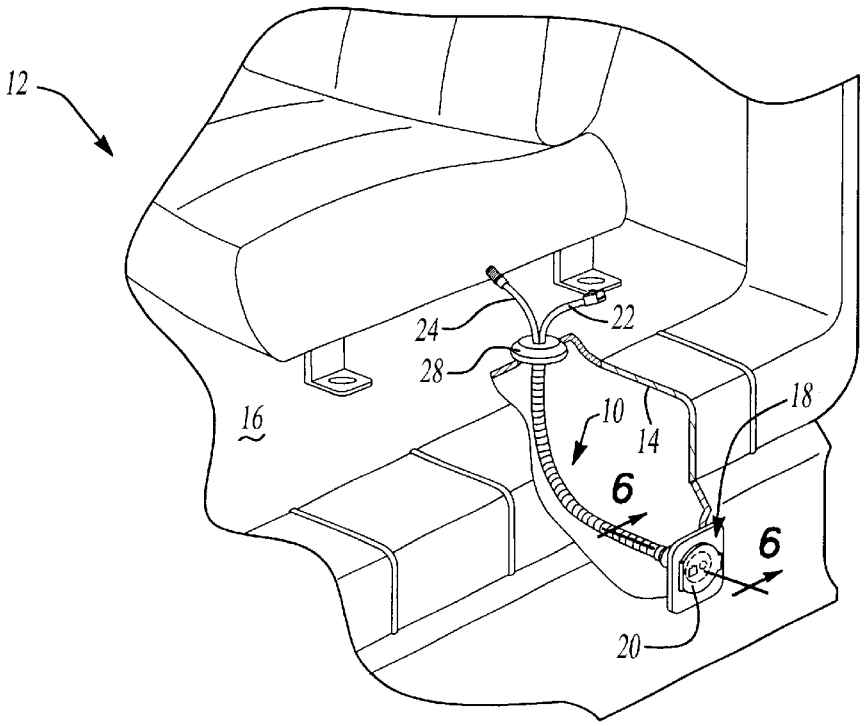
FIG. 2 is a perspective view, partially in section, of the dual media connector shown in FIG. 1.

With initial reference to FIGS. 1 and 2, a dual media connector constructed in accordance with the teachings of the present invention is depicted at reference numeral 10. The dual media connector 10 is coupled to an exemplary motor vehicle 12 having a body 14 defining a passenger compartment 16. The vehicle 12 is equipped with a receptacle 18 mounted to the body 14. As is known in the art, the receptacle 18 is typically constructed as a hollow cylinder mounted to the body 14 to provide convenient access to a portion of the vehicle's wiring harness. The receptacle 18 includes a cover 20 pivotally mounted thereto for selectively providing access to the inside of the cylinder when in an open position and providing a water tight seal when in a closed position.

Referring to FIG. 2, the dual media connector includes a pair of media wires that provide an electrical path to the passenger compartment such as, for example, a phone wire 22 or a coaxial cable 24. In the preferred embodiment, the dual media connector 10 of the present invention is routed beneath the body 14 to minimize intrusion within the passenger compartment 16. The connector 10 generally includes a housing insert 26, a grommet 28, and a conduit 30 sealingly intercoupling the housing insert 26 and the grommet 28. Accordingly, the connector 10 offers protection from the environment beneath the vehicle 12 by housing both the phone wire 22 and the coaxial cable 24 in a substantially waterproof assembly extending from the vehicle passenger compartment 16 to the receptacle 18.

The phone wire 22 includes a modular jack 32 electrically coupled and positioned on each end of the phone wire 22. Similarly, the coaxial cable 24 includes a connector 34 electrically coupled to each end of the coaxial cable 24. Preferably, the connector 34 is a male, crimp-on connector having an internally threaded hexagonal nut 36 rotatably supported thereon. A rear seal 38 is provided to enclose a rear aperture 40 of the housing insert 26 while allowing the coaxial cable 24 and phone wire 22 to pass through a passage 42 extending through the rear seal 38. The grommet 28 sealingly engages the floor panel of the passenger compartment 16. The conduit 30 and two heat shrink tubes 44 interconnect the grommet 28 and the rear seal 38 to enclose and effectively waterproof the dual media connector 10.

Figure 4:
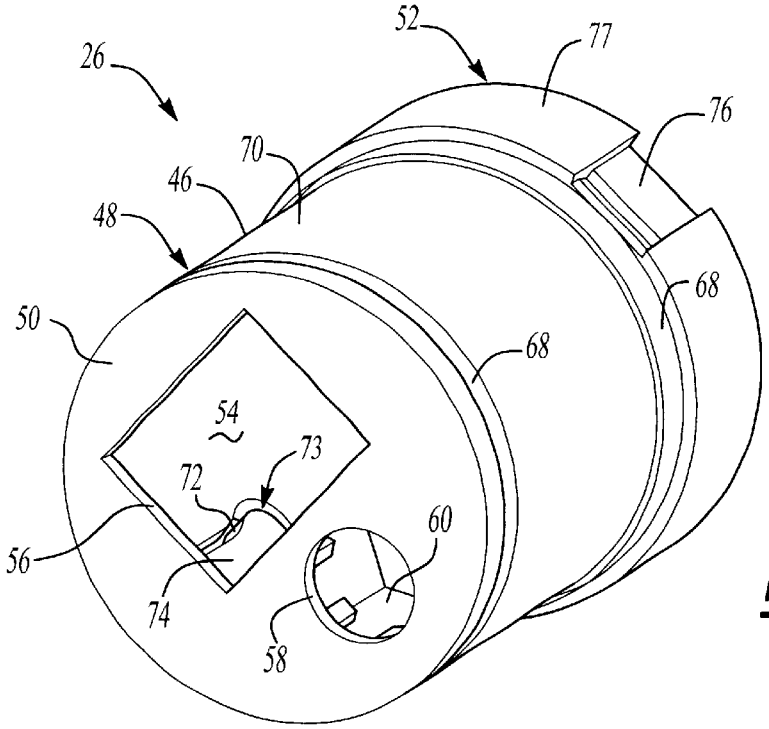
FIG. 4 is a perspective view of a first end of a housing insert constructed in accordance with the teachings of an embodiment of the present invention.
Figure 5:
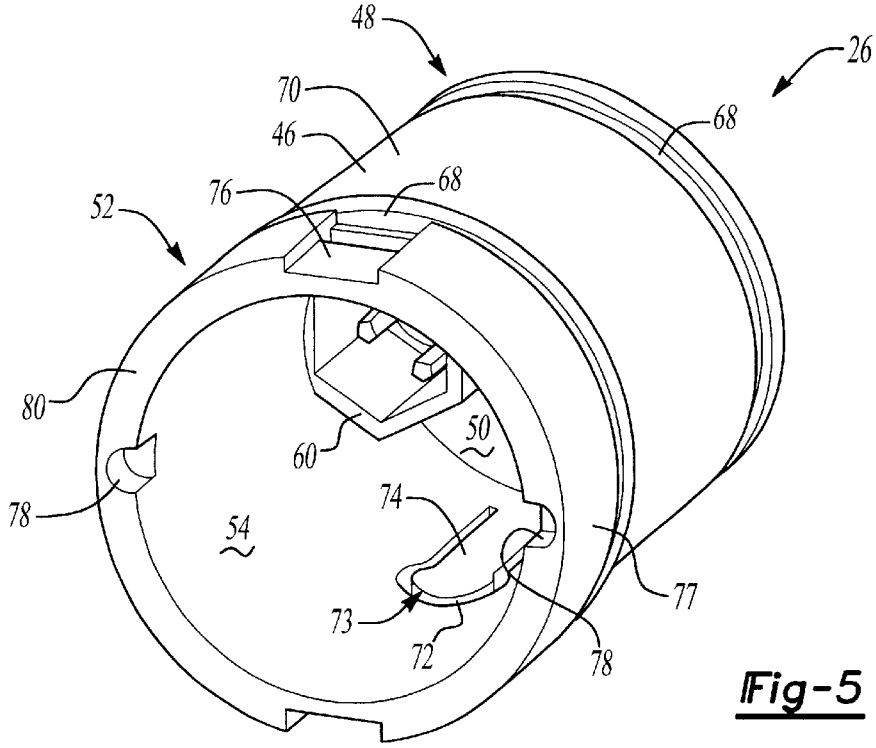
FIG. 5 is a perspective view of a second end of the housing insert shown in FIG. 4.

As best illustrated in FIGS. 4 and 5, the housing insert 26 is generally cup-shaped and includes a cylindrical thin walled body 46 with a first end 48 having an end wall 50, a second end 52 and a cavity 54 extending from second end 52 to the end wall 50. The end wall 50 includes a phone coupler aperture 56 and a coaxial coupler aperture 58 extending therethrough. A hexagonal boss 60 extends from the end wall 50 into the cavity 54 for cooperation with the hexagonal nut 36.

Figure 6:
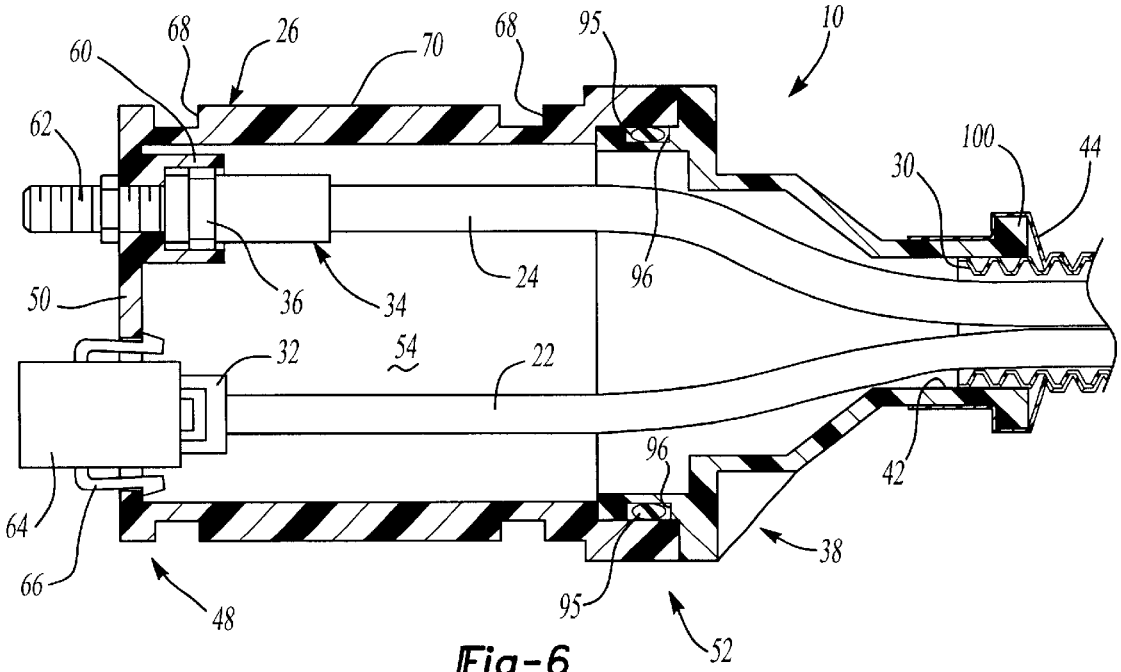
FIG. 6 is a cross-sectional view of a portion of the dual media connector of the present invention taken at line 6—6 as shown in FIG. 2.

With reference to FIGS. 4, 5 and 6, the hexagonal nut 36 of the connector 34 is disposed within the hexagonal boss 60. At this time, a coaxial coupler 62 may be threadingly engaged with the hexagonal nut 36 such that the end wall 50 is clamped therebetween. One skilled in the art will appreciate that the hexagonal boss 60 acts as a socket to resist rotation of the hexagonal nut 36 thereby eliminating the need for a special tool to interconnect the coaxial coupler 62 and the coaxial cable 24.

In similar fashion, a phone coupler 64 is removably mounted to the housing insert 26. Specifically, the phone coupler 64 includes a flexible tab 66 disposed within the phone coupler aperture 56 for biased engagement with the end wall 50. It should be appreciated that the phone coupler 64 is coupled to the housing insert 26 by being disposed within the cavity 54 such that access to the flexible tab 66 may be achieved from outside of the vehicle 12. Therefore, a service technician need not remove the entire dual media connector 10 nor climb beneath the vehicle to service and replace the phone coupler 64. Once the flexible tab 66 is biasedly engaged with the end wall 50, the modular jack 32 and the phone coupler 64 are interconnected.

The housing insert 26 also includes a pair of annular O-ring grooves 68 positioned on an outer surface 70 of the body 46. In the preferred embodiment, O-rings (not shown) are disposed within the grooves 68 to engage the receptacle when the insert is disposed therein so as to provide a waterproof seal between the housing insert 26 and the receptacle 18.

Figure 3:
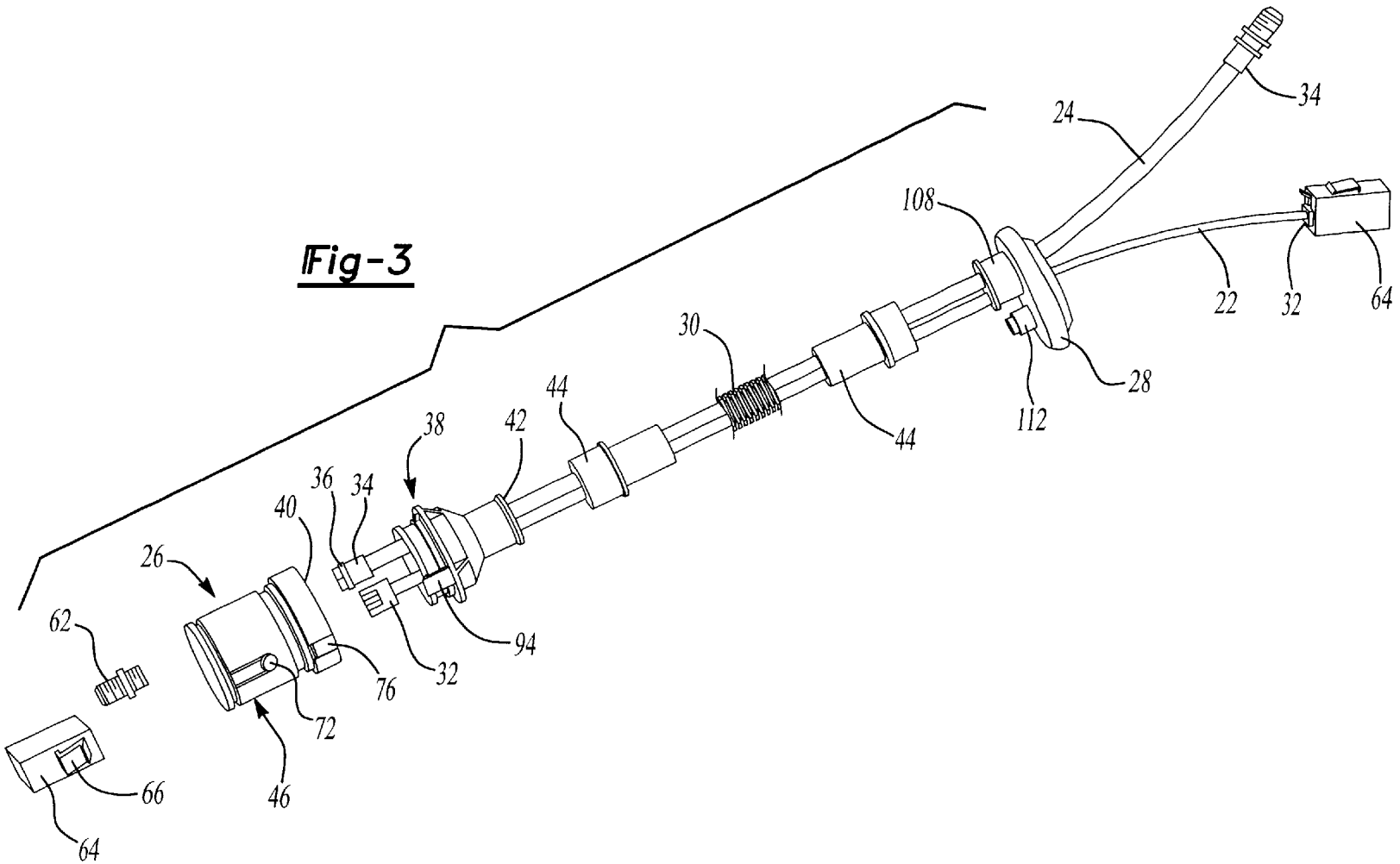
FIG. 3 is an exploded perspective view of the dual media connector constructed in accordance with the teachings of the present invention.

To facilitate removable coupling of the housing insert 26 to the receptacle 18, a snap button 72 (FIG. 3) radially projects from a terminal end 73 of a cantilevered arm 74 that is integrally formed with the body 46. The receptacle 18 includes an aperture (not shown) for receipt of the snap button 72. It should be appreciated that the snap button 72 protrudes past the outer surface 70 of the body 46 and is biasedly loaded against the receptacle wall until the snap button 72 "snaps" or is displaced into the receptacle aperture. Accordingly, the snap button 72 and the cantilevered arm 74 of the present invention effectively reduce the cost and assembly time required to construct a multi-component coupling mechanism having a ball and spring disposed in an aperture as is common in the art.

The second end 52 of the body 46 further includes a pair of keyways 76 formed in a collar 77 as well as a pair of recesses 78 are formed on an end face 80 of the body 46. Both of the keyways 76 and the recesses 78 cooperate with the rear seal 38 in a manner described in greater detail hereinafter.

Figure 7:
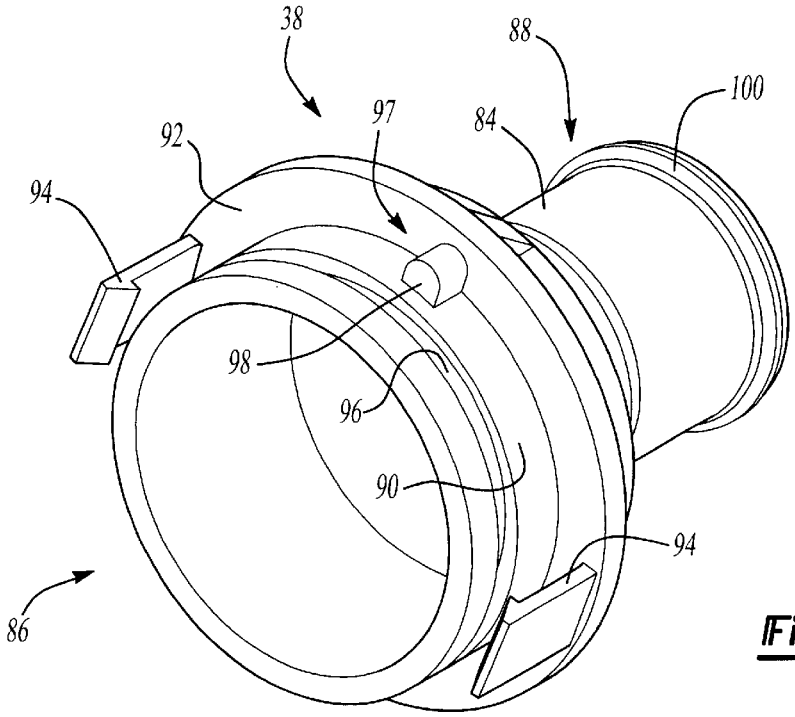
FIG. 7 is a perspective view of a first end of a rear seal constructed in accordance with the teachings of an embodiment of the present invention.
Figure 8:
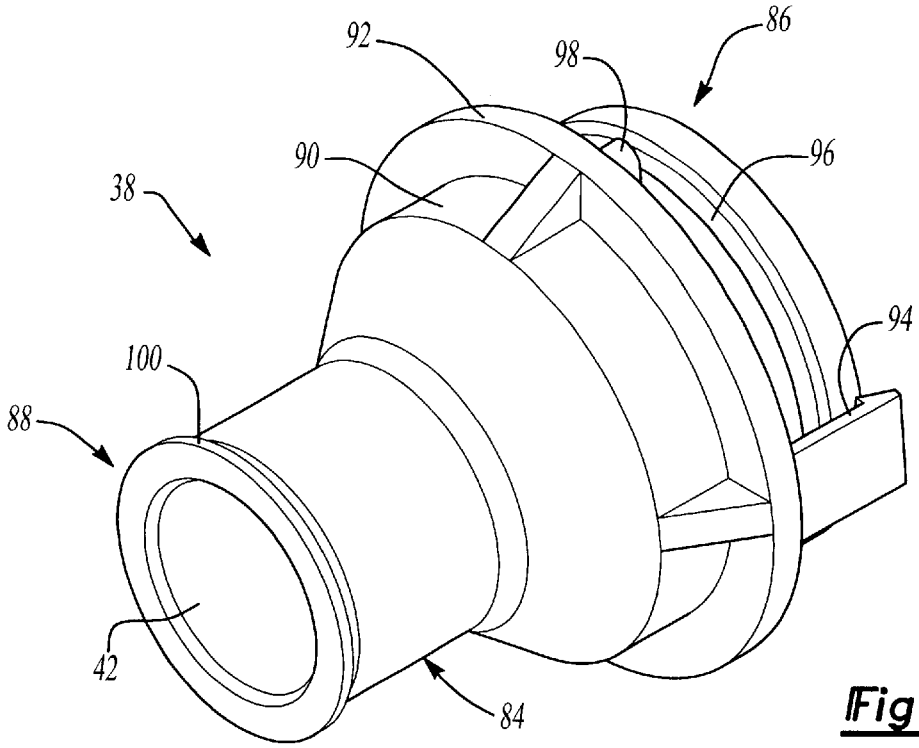
FIG. 8 is perspective view of a second end of the rear seal shown in FIG. 7.

Referring to FIGS. 7 and 8, the rear seal 38 includes a thin walled stepped housing 84 having a first end 86, a second end 88 and an outer surface 90. The housing 84 also includes a radially extending flange 92 axially offset from the first end 86. A pair of clips 94 axially extend from the flange 92 spaced apart from the outer surface 90 of the housing 84. One skilled in the art will appreciate that the distance between each of the clips 94 is less than the distance between the keyways 76 of the housing insert 26 thereby creating a snap-fit coupling between the rear seal 38 and the housing insert 26. It should also be appreciated that the rear seal 38 includes an external annular O-ring groove 96 for receipt of an O-ring 95 sized to engage an inner surface of the housing insert 26.

In order to maintain the structural integrity of the clips 94 during assembly of the dual media connector 10 to the receptacle 18, an indexing mechanism 97 is provided for transferring load from the rear seal 38 to the housing insert 26. The indexing mechanism 97 includes a pair of teeth 98 radially protruding from the outer surface 90 to drivingly engage the recesses 78 during installation of the housing insert 26 to the receptacle. Specifically, it is contemplated that the operator will impart a torque to the rear seal 38 in an attempt to seat the snap button 72 within an aperture (not shown) of the receptacle 18. During this time, the load imparted to the rear seal 38 is transferred to the housing insert 26 through the interconnection of teeth 98 and recesses 78. Accordingly, any shear loads generated at the rear seal 38 during the installation bypass the clips 94 thereby maintaining the structural integrity of the assembly.

Lastly, the rear seal 38 includes a radially extending barb 100 positioned at the second end 88. One skilled in the art will appreciate that the barb 100 functions to retain the heat shrink tube 44 in an installed position after the application of heat whereupon the heat shrink tube contracts to provide a sealed connection. The conduit 30 is also appropriately sized to slip within the heat shrink tube 44 and the passage 42 of the rear seal 38 prior to the application of heat.

As mentioned earlier, serviceability of the couplers is important since frequent connection and disconnection may detrimentally wear the couplers. In the illustrated embodiment, the replaceable media couplers include the phone coupler 64 and the coaxial coupler 62 which are each detachably mounted to the housing insert 26. When the dual media connector 10 is assembled, the couplers function to provide a convenient connection point to each of the media wires from an exterior body panel of the vehicle. Additionally, when an operator wishes to replace a coupler due to excess wear, he or she needs simply to open the cover 20 for service access to the couplers mounted within the housing insert 26. By implementing the proposed design, a majority of the dual media connector remains intact while the serviceable media couplers may be replaced inexpensively and easily from a location outside the vehicle.

Figure 9:
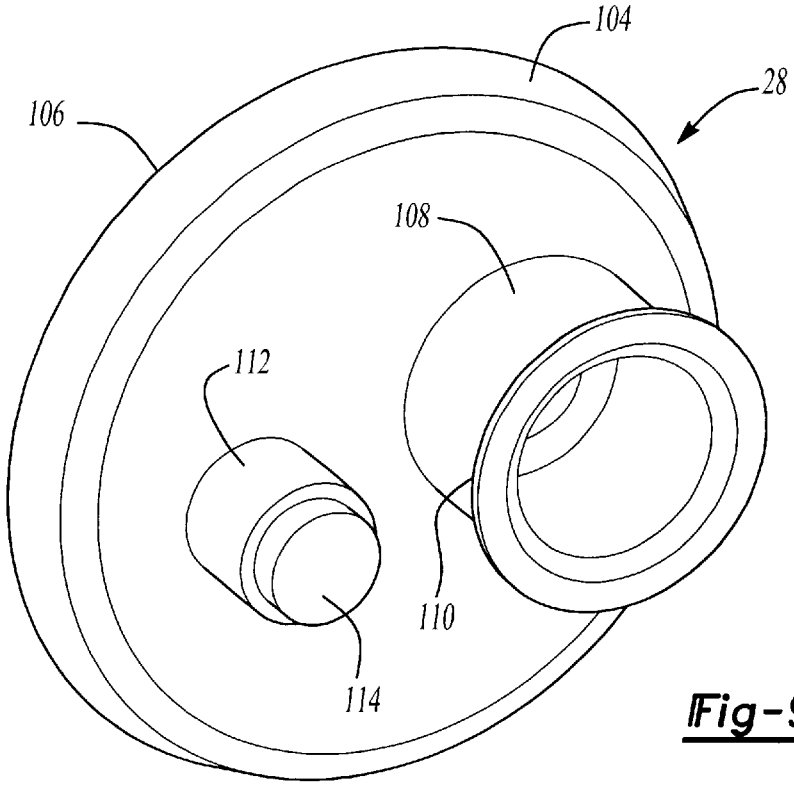
FIG. 9 is a perspective view of a grommet constructed in accordance with the teachings of an embodiment of the present invention.

With reference to FIG. 9, the grommet 28 includes a generally disk shaped plug 104 preferably constructed from a resilient, insulating material for sealing the passenger compartment 16 and protecting the phone wire 22 and coaxial cable 24 from damage. The plug 104 includes an external annular groove 106 sized to engage an aperture (not shown) extending through the bottom of the passenger compartment 16. A first generally hollow nipple 108 having a barb 110 extends outwardly from the plug 104 to cooperate with another heat shrink tube 44. As earlier described with reference to barb 100, the barb 110 cooperates with the heat shrink tube 44 to maintain the relative axial positioning of the components prior to the application of heat. The first nipple 108 includes a membrane (not shown) for enclosing the nipple thereby allowing use of the grommet 28 in applications where the media wires are to be retrofitted or not used at all. When an installer wishes to use the grommet 28 in conjunction with the media wires 22 and 24 as previously described, the membrane is simply pierced to allow the media wires to be disposed therethrough. The grommet 28 also includes a second nipple 112 positioned adjacent to first nipple 108. The second nipple 112 is also generally hollow including a membrane 114 for maintaining the seal between the passenger compartment and the underside of the body 14 if the second nipple 112 is not to be used for housing additional wires. It is contemplated that the installer of the dual media connector 10 of the present invention would clip off the end of the second nipple 112 if an aperture for a tertiary line were required. It should be appreciated that a wire for controlling an inverter for cab power may be disposed within the second nipple aperture.

Therefore, it should be appreciated that the configuration and operation of the dual media connector provides manufacturing and operational advantages over the prior art. Specifically, the dual media connector 10 of the present invention provides a dual media communication path within a single, easily serviceable mount.

The foregoing discussion discloses and describes merely exemplary embodiments of the present invention. One skilled in the art will readily recognize from such discussion, and from the accompanying drawings and claims, that various changes, modifications and variations may be made therein without department from the spirit and scope of the invention as defined in the following claims.

What is claimed is:

1. A dual media connector for coupling two distinct media signals to communication devices within a vehicle, the vehicle having a body defining a passenger compartment, the dual media connector comprising:

a first media wire having a first and second end;

a second media wire having a first and second end;

a housing insert including a generally cylindrical hollow body with an end wall defining a cavity;

a first coupler disposed in said cavity and removably mounted to said end wall, said first coupler having a first end and a second end, said second end detachably coupled to said first end of said first media wire, said first end to receive one of the two media signals;

a second coupler disposed in said cavity and removably mounted to said end wall, said second coupler having a first end and a second end, said second end detachably coupled to said first end of said second media wire, said first end to receive the other of the two media signals; and wherein said second ends of said first and second media wires are to be disposed within the passenger compartment for connection with the communication devices.

2. The dual media connector of claim 1 wherein said housing insert includes an integrally molded snap button.

3. The dual media connector of claim 2 wherein said housing insert includes an outer surface having an annular groove for receipt of a seal.

4. The dual media connector of claim 1 wherein said end wall includes a first aperture and a second aperture extending therethrough, said first coupler disposed in said first aperture and including a tab biasedly engaged with said end wall.

5. The dual media connector of claim 4 wherein said second coupler is disposed in said second aperture, said second end of said second coupler threadingly engaged with said first end of said second media wire.

6. The dual media connector of claim 5 wherein said first end of said second media wire includes a hexagonal nut engaged with said housing insert such that said hexagonal is restricted for rotation.

7. The dual media connector of claim 6 wherein said end wall is clamped between said hexagonal nut and said second coupler.

8. The dual media connector of claim 1 further including a rear seal coupled to said housing insert for enclosing said cavity, said rear seal including a clip biasedly engaging said housing insert.

9. The dual media connector of claim 8 wherein said rear seal includes an outwardly projecting barb engaging a heat shrink tube, said heat shrink tube sealingly interconnecting said rear seal and a conduit.

10. The dual media connector of claim 8 wherein said rear seal includes an indexing tooth protruding from an end face of said rear seal and wherein said housing insert includes a recess sized to cooperate with said indexing tooth to provide a torsional load transfer path from said rear seal to said housing insert.

11. A dual media connector interconnecting a vehicle passenger compartment and a receptacle mounted to a body panel of the vehicle, the dual media connector comprising:

first and second media wires; and a housing, said housing coupled to said first and second wires, said housing including a generally cylindrical body having a first end, a second end, and an outer surface;

an end wall defining a cavity, said end wall having a first aperture and a second aperture extending therethrough; and a boss protruding from said end wall into said cavity, said boss circumscribing said second aperture to restrain the second media wire from rotation.

12. The housing insert of claim 11 further including a snap button positioned at a terminal end of a cantilevered arm integrally formed in said body; said snap button biasedly engaging the receptacle.

13. The housing insert of claim 12 wherein the dual media connector further includes a rear seal and said housing includes a keyway cooperating with a clip axially extending from the rear seal.

14. The housing insert of claim 13 wherein said housing includes a recess positioned on an end face thereof for engagement with an indexing tooth axially extending from the rear seal.

15. The housing insert of claim 12 wherein said outer surface includes an annular groove for positioning a seal therein.

16. A vehicle and dual media connector combination, the combination comprising:

a body defining a passenger compartment, said passenger compartment housing a first communications device and a second communications device;

a receptacle mounted to said body, said receptacle having a cover coupled thereto; and said dual media connector having a first media wire and a second media wire disposed within each of a housing insert, a rear seal, a conduit and a grommet, said first and second media wires to electrically interconnect the first and second communications devices with external communication signals.

17. The vehicle dual media connector combination of claim 16 wherein said dual media connector includes a replaceable first coupler connected to said first media wire and a replaceable second coupler connected to said second media wire.

18. The vehicle dual media connector combination of claim 17 wherein said housing insert includes a cantilevered snap button biasedly engaged with said receptacle.

19. The vehicle dual media connector combination of claim 18 wherein said housing insert, said rear seal, said conduit and said grommet are sealingly interconnected in series.

20. The vehicle dual media connector combination of claim 19 wherein said grommet sealing engages an aperture extending through said body into said passenger compartment.

* * * * *